US008919338B2

(12) United States Patent
McNamee et al.

(10) Patent No.: US 8,919,338 B2
(45) Date of Patent: Dec. 30, 2014

(54) SLIDING AND TILTING DOOR ASSEMBLY

(75) Inventors: Robert McNamee, Iowa City, IA (US); Thomas Miller, Kalona, IA (US); Edward R Cook, Cedar Rapids, IA (US)

(73) Assignee: ACP, Inc., Cedar Rapids, IA (US)

( * ) Notice: Subject to any disclaimer, the term of this patent is extended or adjusted under 35 U.S.C. 154(b) by 589 days.

(21) Appl. No.: 13/321,765

(22) PCT Filed: May 20, 2010

(86) PCT No.: PCT/US2010/035574

§ 371 (c)(1), (2), (4) Date: Nov. 21, 2011

(87) PCT Pub. No.: WO2010/135531

PCT Pub. Date: Nov. 25, 2010

(65) Prior Publication Data

US 2012/0060821 A1 Mar. 15, 2012

Related U.S. Application Data

(60) Provisional application No. 61/179,941, filed on May 20, 2009.

(51) Int. Cl.

| | |
|---|---|
| ***F24C 15/02*** | (2006.01) |
| ***E05D 15/46*** | (2006.01) |
| ***E05D 15/56*** | (2006.01) |
| ***E05D 15/58*** | (2006.01) |
| *E05D 15/48* | (2006.01) |

(52) U.S. Cl.

CPC ..... *F24C 15/023* (2013.01); *E05D 15/46* (2013.01); *E05D 15/56* (2013.01); *E05D 15/582* (2013.01); *F24C 15/022* (2013.01); *E05D 2015/485* (2013.01); *E05Y 2201/416* (2013.01); *E05Y 2900/20* (2013.01); *E05Y 2900/308* (2013.01)

USPC ..... 126/197; 126/192; 126/194; 126/190

(58) Field of Classification Search

CPC ..... F24C 15/022; F24C 15/023; F24C 15/026

USPC ..... 126/197, 192, 194, 190

See application file for complete search history.

(56) References Cited

U.S. PATENT DOCUMENTS

| | | | | |
|---|---|---|---|---|
| 2,953,419 | A * | 9/1960 | Ingolia | 312/276 |
| 3,116,903 | A * | 1/1964 | Grantham | 248/134 |
| 3,507,267 | A * | 4/1970 | Lafforgue | 126/200 |
| 4,149,518 | A | 4/1979 | Schmidt et al. | |

FOREIGN PATENT DOCUMENTS

| | | |
|---|---|---|
| BE | 757281 | 3/1971 |
| DE | 4103651 | 8/1992 |
| EP | 1925770 | 5/2008 |

(Continued)

*Primary Examiner* — Avinash Savani

(74) *Attorney, Agent, or Firm* — Diederiks & Whitelaw, PLC

(57) ABSTRACT

A cooking appliance includes an outer cabinet within which is provided an oven cavity which can be selectively accessed by movement of a door mounted through a door linkage system which enables the door to be shifted between opened and closed positions through either sliding or tilting movements. In particular, the door can be automatically or manually shifted between open and closed positions, through either the sliding or tilting motions. In accordance with another aspect of the invention, the door can be automatically opened at the end of a process or cooking cycle, or manually opened.

25 Claims, 7 Drawing Sheets

(56) References Cited

FOREIGN PATENT DOCUMENTS

| | | |
|---|---|---|
| JP | 59-097427 | 6/1984 |
| JP | 63-156851 | 10/1988 |
| JP | 6081547 | 3/1994 |
| JP | 09-126459 | 5/1997 |
| WO | WO02/059528 | 8/2002 |

* cited by examiner

SLIDING AND TILTING DOOR ASSEMBLY

CROSS-REFERENCE TO RELATED. APPLICATIONS

The present application represents a National Stage application of PCT/US2010/035574 entitled "Sliding and Tilting Door Assembly" filed May 20, 2010 which claims the benefit of U.S. Provisional Patent Application Ser. No. 61/179,941 entitled "Sliding and Tilting Door Assembly" filed May 20, 2009.

BACKGROUND OF THE INVENTION

1. Field of the Invention

The present invention pertains to the art of cooking appliances and, more specifically, to a selectively sliding and tilting door assembly particularly designed for use on a microwave oven.

2. Discussion of the Prior Art

It is widely known to provide a cooking appliance with a single, generally rectangularly shaped door that pivots about a defined axis. That is, top and bottom portions of the oven door are pivoted to a cabinet of the oven and the door is pulled outward from the appliance about a hinge axis to provide access to the oven cavity. For example, it is common to have a microwave oven door which is pivoted about a vertical axis. While this type of oven door has found wide spread use, it is not entirely satisfactory for every application. For instance, an oven door that rotates about a vertical axis projects outward from the appliance a considerable distance. This distance must be taken into consideration when deciding where to locate the appliance. Otherwise, the opened door could interfere with traffic or other patterns or even access to surrounding areas. In addition, such an oven door may require a user to move to one side of the appliance to fully open the door. In order, to address this problem, some manufacturers provide their ovens with other door configurations, such as doors which pivot about horizontal axes, with such arrangements having similar drawbacks.

The problems of access and space is of particular concern in connection with commercial kitchens such as found in fast food chains. In these locations, time and space are critical. In any case, despite the existence of various known door configurations, particularly for oven doors, there still is seen to exist a need for a. versatile door system. More specifically, there exists a need for a door system which can be used in various modes and which permits a door to move between opened and closed positions in various ways, thereby providing for at least, different access configurations.

SUMMARY OF THE INVENTION

The present invention is directed to a door linkage system for a. cabinet, particularly a cabinet of a cooking appliance and, more particularly, a cabinet of a microwave oven, wherein the door can be shifted between opened and closed positions through either sliding or tilting movements. In accordance with another aspect of the invention, the door can be automatically opened at the end of a process cycle, or manually opened.

In accordance with the most preferred embodiment of the invention, an oven cavity is established within a microwave oven cabinet, with the oven cavity having top, bottom, rear and opposing side walls that collectively define a frontal opening. In accordance with the invention, the cabinet is provided with a door which can be automatically or manually shifted between open and closed positions. More particularly, the door can be manually or automatically shifted, through either sliding or tilting motions, between opened and closed positions.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
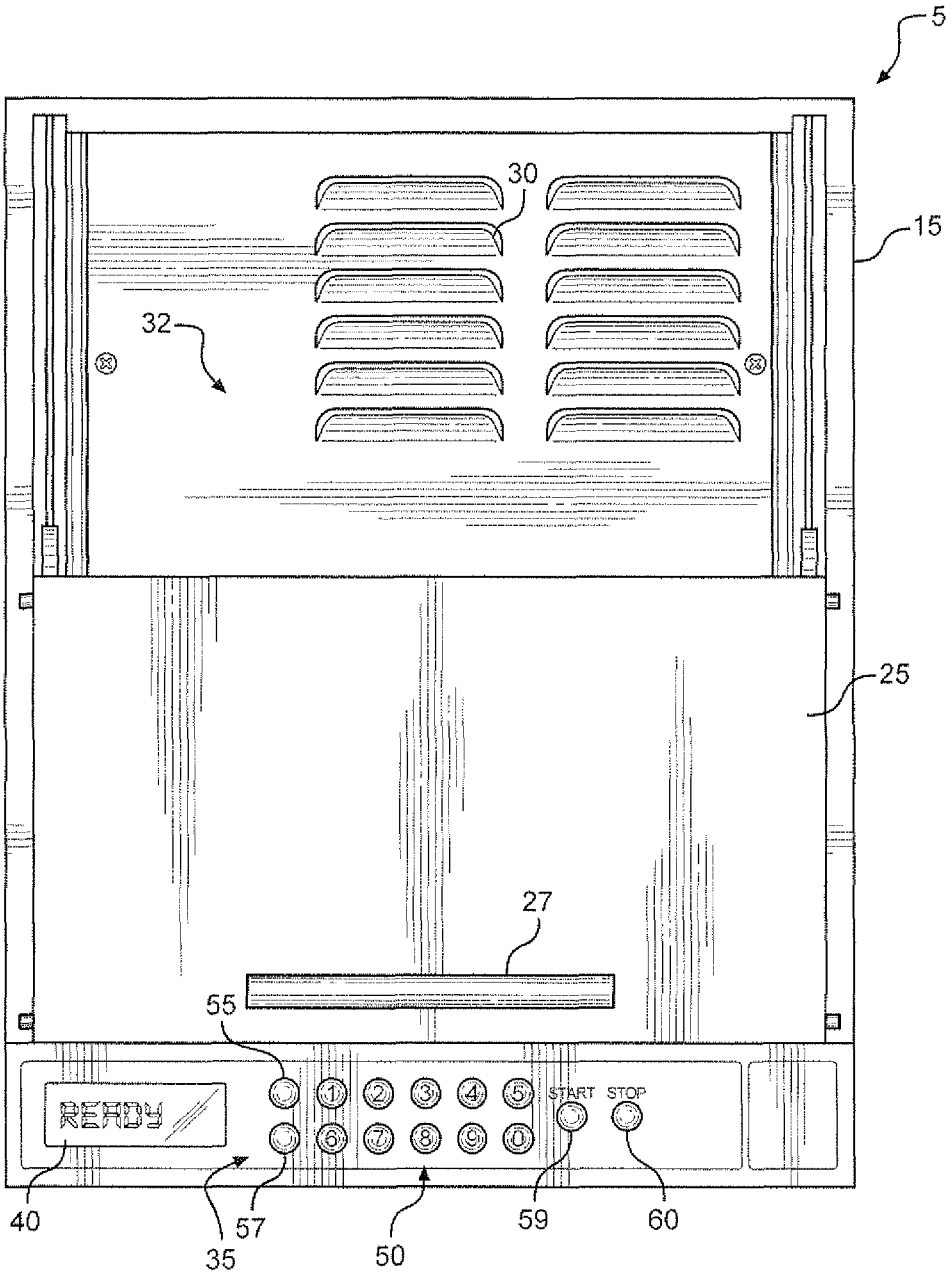
FIG. 1 is a front elevational view of a microwave oven incorporating the sliding and tilting door assembly of the invention, with the door shown slid into an opened position.
Figure 2:
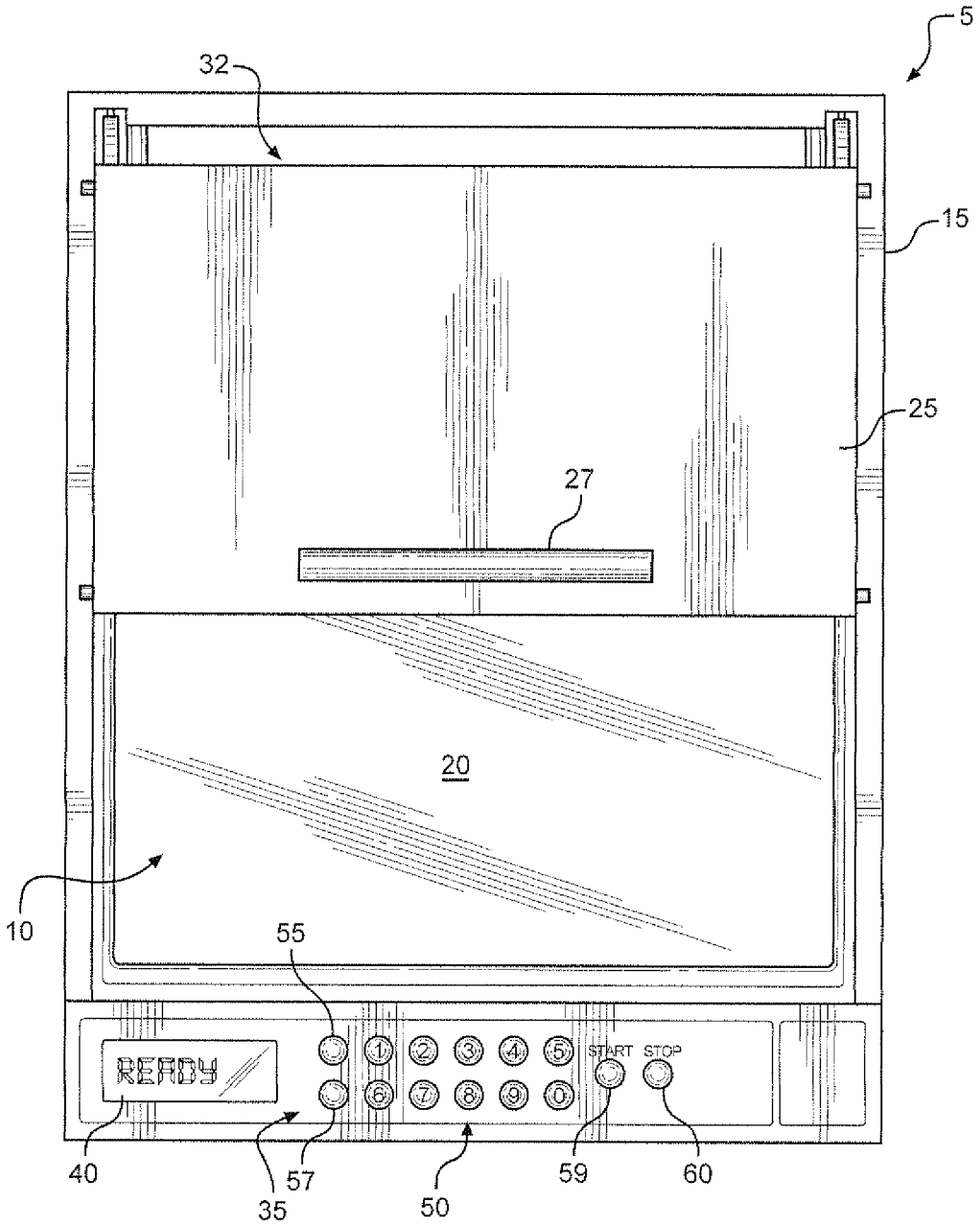
FIG. 2 is a front elevational view of the microwave oven incorporating the sliding and tilting door assembly of the invention, with the door shown slid into a closed position.

With initial reference to FIGS. 1 and 2, a microwave oven constructed in accordance with the present invention is generally indicated at 5. As shown, microwave oven 5 includes an oven or process cavity 10 arranged within an outer cabinet 15 defined, at least in part, by a rear wall 20 exposed upon opening a door 25 having a handle 27. Door 25 is vertically, slidably movable between a closed position as shown in FIG. 1 wherein venting louvers 30 in an upper component housing portion 32 are exposed and an open position exposing cavity 10 as shown in FIG. 2. In the embodiment shown, arranged below cavity 10 on a front portion of microwave oven 5 is a control panel 35 including a multi-segment display 40, a numeric keypad section 50, an entry button 55, a power level button 57, a start button 59 and a stop button 60. In the embodiment shown, cavity 10 is in the order of 13 inches (approx. 33 cm) wide, 8 inches (approx. 20 cm) deep and 6 inches (approx. 15 cm) in height. However, at this point, it should be noted that the particular construction, size and control panel configuration shown in these figures are only presented for exemplary purposes and can vary greatly in accordance with the overall invention. Although not shown, microwave oven 5 includes one or more magnetrons for generating microwaves which are directed into oven cavity 10 during a cooking operation. With this basic arrangement in mind, the present invention is particularly directed to the mounting and movement of door 25 as detailed fully below.

As indicated above, the door 25 of microwave oven 5 can open through each of a sliding action and a tilting action as will be detailed more fully below. To perform these functions, door 25 is mounted through the structure best shown in FIGS. 3 and 4. Again, the depicted, preferred embodiment of the invention presents oven 5 as a microwave oven having a cooking or process cavity 10 having an open frontal portion which is adapted to be closed by door 5. Pivotally mounted at a frontal end (not separately labeled) is a combination spring and damper assembly (GSR) 75. This pivotal mounting establishes a fixed pivot axis. In one aspect, spring and damper assembly 75 provides force to open door 25 and, in another aspect, provides operational damping during the movement of door 25. Although various types of spring and damper combinations could be employed, an extensible, coil spring wrapped pneumatic damper is preferably employed. At this point, it should also be understood that the damping is not actually required for operation but does improves smoothness of operation.

A trailing arm 85 is pivotally connected to door 25 at a pivot point F. Basically, trailing arm 85 converts force of spring and damper assembly 75 into an opening force at a top joint of door 25. A tilt link 90 connects to a leading arm 100 at a joint L and is provided with a cam follower 110 shown in the form of a pin H. A cam link 120 is pivotally mounted within outer cabinet 15 at a joint C. Cam link 120 acts through cam follower 110 with force from a cam spring 125 acting on a cam link profile K to provide a desired force at a leading edge door connection L at a given tilt position for door 25.

More specifically, cam follower 110 is held against cam link 120 by cam spring 125, and employs sliding or rolling contact against cam link 120 to provide the desired force on leading arm 100. At the same time, cam spring 125 is connected to cam link 120 at pin J, while acting on cam link 120 to create a moment about pivot point C which creates a reaction force at contact pin H between cam follower 110 and cam link profile K.

At the same time, leading arm 100 is connected to tilt link 90 at joint L and door 25 at joint M. Leading arm 100 interacts with a latch pawl 140 along a leading arm latch profile N to provide latching for door 25. Latch pawl 140 is preferably mounted to appliance 5 at a joint P, while defining a pin or roller that interacts with leading arm profile N to establish a latch that resists an opening force applied by spring and damper assembly 75.

A latch spring 145 is connected to oven 5 at Q and to pawl 140 at R. Latch spring 145 acts on latch pawl 140 to provide a moment on latch pawl 140 about joint P to provide a force establishing an engagement between latch pawl 140 and leading arm 100 at leading arm profile N. An unlatch actuator 150, such as a solenoid actuator, connects to latch pawl 140. Unlatch actuator 150 acts on latch pawl 140 to provide a force applied at connection point S to overcome a force of latch spring 145 in order to disengage latching at pawl 140 and leading arm profile N.

Figure 3:
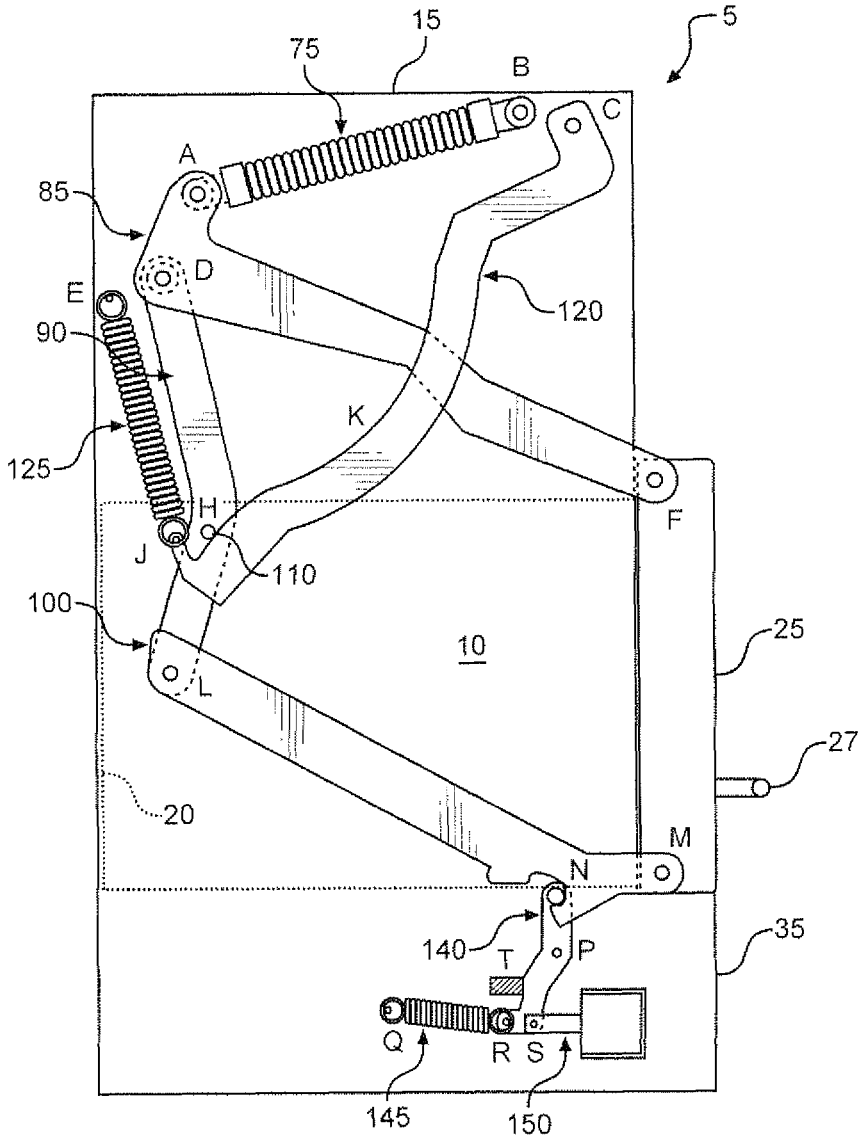
FIG. 3 is a schematic side view of the sliding and tilting door assembly with the door closed.
Figure 4:
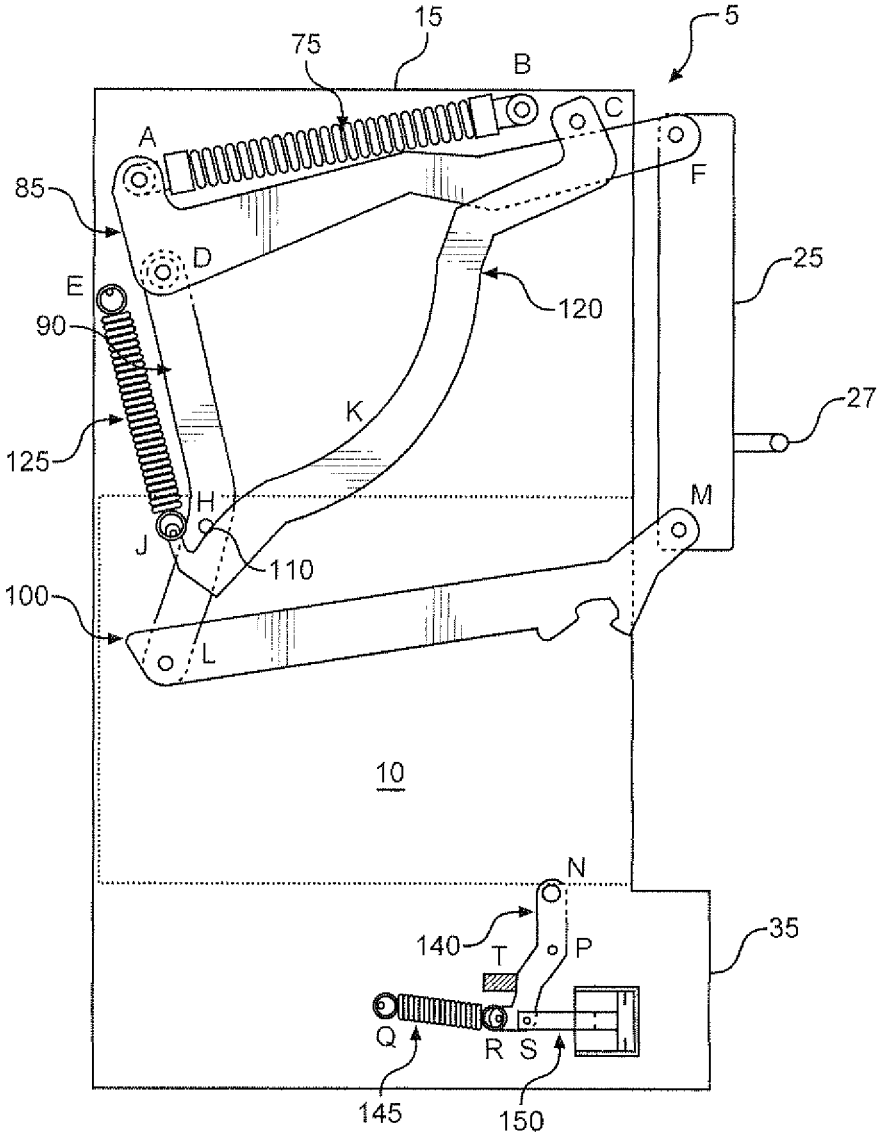
FIG. 4 is a schematic side view of the sliding and tilting door assembly of FIG. 3 with the door slid open.
Figure 5:
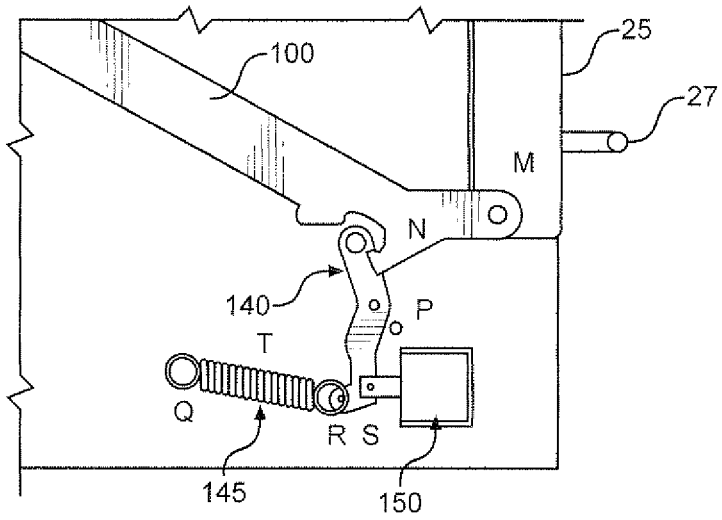
FIG. 5 is a schematic side view of a latch employed with a sliding and tilting door assembly of the invention.

With specific reference to FIGS. 3-5, the sliding action of the door is described as follows:

I. Normal Operation Mode Closing

In the open position (see FIG. 4) the door 25 is held in the full open position by the force of the spring and damper assembly 75 acting on the trailing arm 85 at a joint A, creating a moment about D, which creates force on the door 25 at F which holds the door 25 open. Positioning of the leading edge of the door 25 is maintained by the reaction between the cam follower 110, the cam link profile K, and the moment on the cam link 120 created by the force applied by cam spring 125. The cam link profile K is configured such that, when the door 25 is near the closed or operating position, the reaction between the cam follower 110 and cam link profile K creates a moment about D acting on the tilt link 90 such that the tilt link 90 acts through the leading arm 100 to pull the leading edge of the door 25 towards the operating position next to the appliance.

To close the door 25, the operator applies a closing force on the door 25 through handle 27 which is sufficient to overcome the force of the combination spring and damper assembly (GSR) 75. This moves the door 25 towards the latch pawl 140. As the door 25 approaches the closed position (see FIG. 5), the leading arm latch profile N comes into contact with the latch pawl 140. The leading arm profile N is configured such that it acts on the latch pawl 140 to overcome the moment, about P, created by latch spring 145, displacing the latch pawl 140 and allowing the latch pawl 140 to travel around the leading arm latch profile N.

When the door 25 has reached the fully closed position, the leading arm latch profile N is configured to allow the latch pawl 140 to move behind the leading arm latch profile N. The moment on the latch pawl 140 about P, rotates the latch pawl 140 into the latched position. In this position, the engagement between the latch pawl 140 and leading arm profile N is configured such that the opening force on door 25 created by the combination spring and damper assembly 75 acting through the latch pawl 140 is at or near perpendicular to the leading arm latch profile N. At this point, the operator removes the force applied to the door 25 and the door 25 is retained in the latched position, i.e., the door 25 is in the closed and latched position (see FIG. 3). The appliance control initiates the opening cycle by actuating the unlatch actuator 150. The unlatch actuator 150 acts against the pawl 140 to overcome the moment about D created by the latch spring 145 and creates a moment about D in the opposite direction. This moment acts on the latch pawl 140 and rotates it such that the latch pawl 140 is no longer engaged with the leading arm latch profile N. When the latch pawl 140 is disengaged from the leading arm 100, there are no forces present to resist the force of the spring and damper assembly 75 which acts on the trailing arm 85 at A, thereby creating a moment about D which creates an opening force on the door 25 at F, leading to the door 25 slidably moving to the fully open position shown in FIG. 4.

II. Automatic Door Opening

Automatic unlatching enables the door to open automatically at the end of the process cycle. This saves the operator the time and motion required to open the door, leaving the operator available to perform other tasks. In addition the automatic opening provides visual cue that the appliance process is complete.

III. Manual Opening (Manual Method for Unlatching Door)

Starting with the door 25 is in the closed and latched position (see FIG. 3), the operator applies a door opening force to the door 25 through handle 27. Some component of this force is directed outward from the appliance. To this end, at least the lower door location and grip configuration of handle 27 assures that this outward force component is created by a typical interaction between the operator and the door handle 27. In any case, the outward component of this force applied to the door 25 acts through the leading arm 100 to overcome the moment about D on the tilt link 90 and slightly rotates the tilt link 90 which moves leading arm 100 and leading arm latch profile N away from the latched position. The latch pawl 140 is prevented from moving with the leading arm 100 by contact with bumper structure T. This motion of the leading arm 100 with respect to the latch pawl 140 acts to disengage the latch pawl 140 from the leading arm latch profile N. When the displacement is sufficient for the unlatching to be complete, the spring and damper assembly 75 acts through the overall mechanism to move the door 25 to the open position. The reaction between the cam link 120 and the tilt link 90 will return the leading edge of the door 25 at M to the operating position.

At this point, it should be noted that optional manual unlatch methods can be employed as well. For instance, the operator can apply a force to a mechanism (not shown) which acts either directly or indirectly on the latch pawl 140 to perform unlatching as described in the automatic door opening sequence above. In an alternative arrangement, the operator can apply a force to a mechanism that acts either directly or indirectly to displace the leading arm 100 with respect to the latch pawl 140 as described in the manual opening sequence above. This could be accomplished by displacing the leading edge of the door or slightly rotating the tilt link.

With specific reference to FIGS. 6-9, the tilting action of the door 25 is described as follows:

IV. Door Tilt Operation

The main purpose of the tilt operation is to enable the door 25 to quickly be rotated about the trailing arm joint at F and maintained in a rotated position for improved access to the oven cavity 10. To tilt the door 25, the operator applies a pulling force to the leading edge of the door 25 and continues to apply a force approximately tangent to the door movement as the door 25 pivots about joint F. The door 25 is intended to be in the open position for tilting, but the tilt can be initiated to any position. However, the spring and damper assembly 75 and cam reaction forces tend to pull the trailing arm 85 to the open position when the door 25 is substantially rotated away from the operating or closed position.

Figure 6:
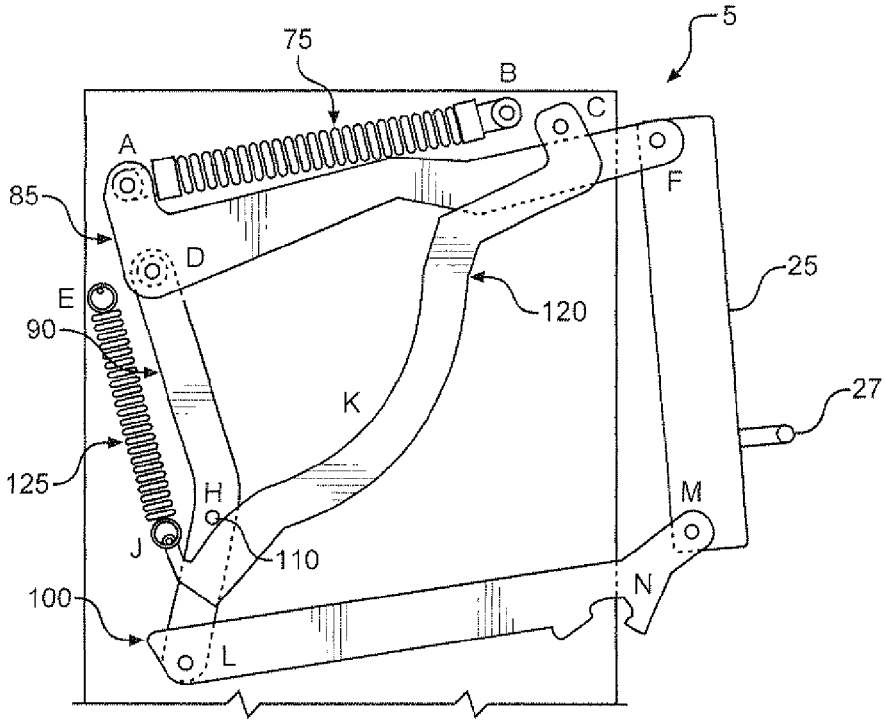
FIG. 6 is a schematic side view of the door assembly during an initial tilt opening phase.
Figure 7:
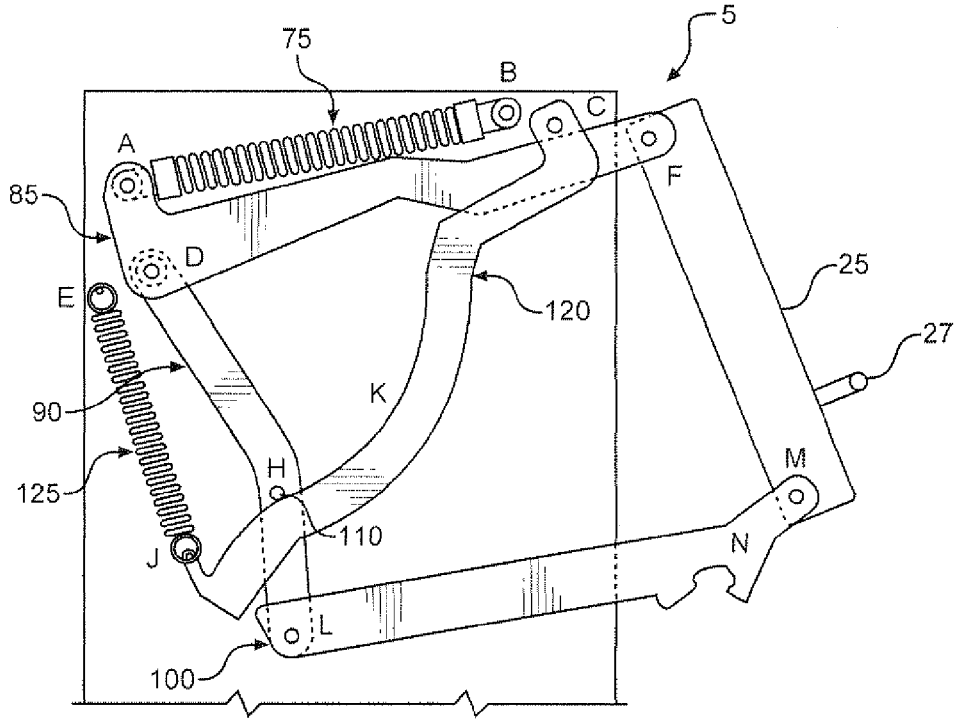
FIG. 7 is a schematic side view of the door assembly during an neutral tilt opening phase.

As the door 25 is rotated to the tilted position, the configuration of the cam link 6 with cam link profile K acts on the cam follower 110 due to a moment about point C created by force from cam spring 125 (hereafter referred to as "cam reaction"). As depicted, the mechanism is configured to provide variable forces through the swing. More specifically, at small angles of door displacement from the operating position, the reaction pulls the leading edge of the door 25 towards the operating position and holds it in that position (FIG. 6). As door displacement from the operating position is increased, the door 25 reaches a neutral point where the cam reaction is neutral such that the cam reaction is not forcing the door 25 in either direction. When moving the door 25 to the operating position from the tilt position, the operator will feel the mechanism pull the door 25 towards the operation position when it is moved past the neutral point (FIG. 7).

Figure 8:
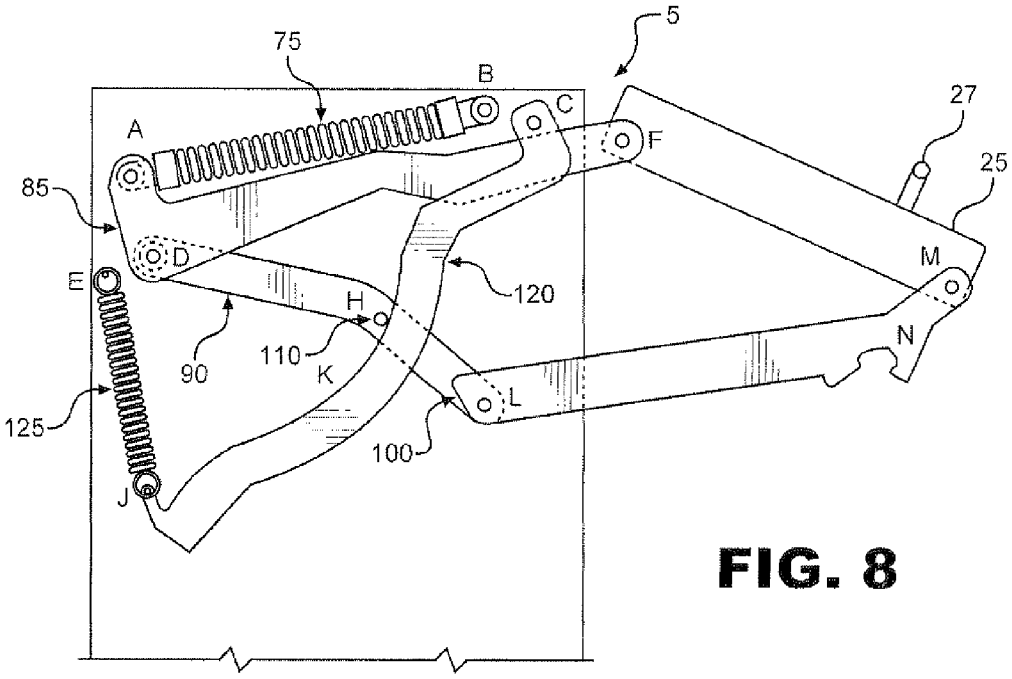
FIG. 8 is a schematic side view of the door assembly during an reaction tilt opening phase.
Figure 9:
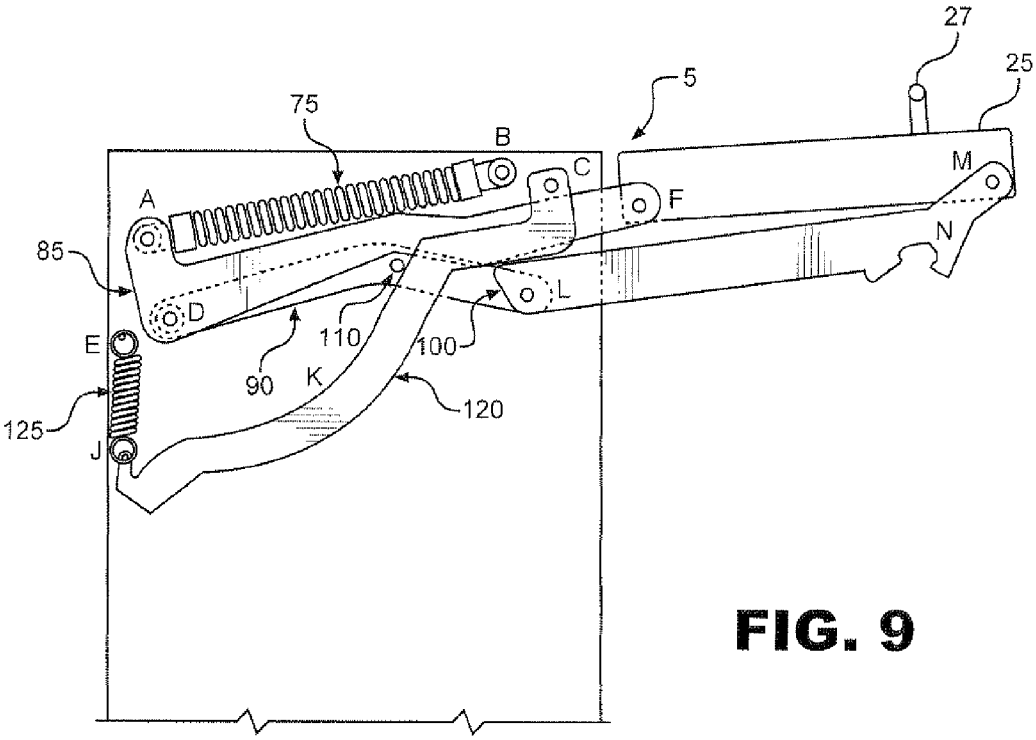
FIG. 9 is a schematic side view of the door assembly during a full tilt opening phase.

As displacement is increased, the cam reaction changes direction and resulting forces are slightly biased towards moving the door 25 to the full tilt position. This provides a light feel for the operator and gives some control to the motion. When moving the door 25 from the tilt position to the operation position, this portion of the cam inhibits the door 25 from slamming back to the operation position. (FIG. 8). As the door 25 approaches the fully tilted position, the cam reaction creates sufficient force that the door 25 is held in the tilted position without any operator force applied. Therefore, the operator must apply a force to the door 25 to start the motion back towards the operating position (FIG. 9).

Based on the above, it should be readily apparent that the invention provides a versatile door assembly which can be manually or automatically shifted between closed and opened positions, with the door being shiftable through either a sliding or a tilting movement. More specifically, the open and closing mechanism employs a linkage system which can provide a slide action which allows the door to move between closed and open positions in an approximately linear motion, thus minimizing intrusion of the door action into an adjacent workspace. With this arrangement, an operator does not have to swing the door open or change position to accommodate door swinging, thereby improving efficiency and flexibility. In addition, access to the oven cavity or other internal cabinet region is the same from either side of the cabinet. Particularly advantageous in connection with fast food chains, the door assembly enables process items to be placed in front of the appliance because the door does not need to swing through a space in front of the appliance. In addition, the door can open automatically upon completion of a process operation, thereby providing a visual cue that the operation is finished. The net effect is significantly reduced operator time and effort. In connection with tilting the door for interior access, the linkage mechanism can be tailored to provide a desired operator feel or door motion. As disclosed, the mechanism advantageously provides a pull back force at small angles of displacement which resists movement of the door from an operating position. As the tilt angle is increased, the reaction of the mechanism provides a neutral or slight force aiding the movement towards the tilt position. Finally, at the full tilt position, the mechanism increases the force to hold the door in that position and provide a detent feel for the operator. Although described with reference to preferred embodiments of the invention, it should be readily understood that various changes and/or modifications can be made to the invention without departing from the spirit thereof. In general, the invention is only intended to be limited by the scope of the following claims.

We claim:

1. An oven comprising:

an outer housing within which is defined an oven cavity, said outer housing having an frontal opening exposing the oven cavity;

a door mounted for movement between first and second open positions exposing the oven cavity and a closed position extending across the frontal opening; and a door linkage assembly enabling the door to be shifted between the open and closed positions selectively through each of sliding and tilting movements wherein the door is slid to the first open position by vertically shifting the door upward along the outer housing to expose the oven cavity and the door is tilted to the second open position by pivoting the door upward and outward away from the outer housing to expose the oven cavity.

2. The oven according to claim 1, wherein the door linkage assembly includes:

a first arm connected to the door; and a spring assembly interconnecting the first arm and the outer housing.

3. The oven according to claim 2, wherein the first arm converts force of the spring assembly into an opening force at a top portion of the door.

4. The oven according to claim 2 wherein the spring assembly forms part of a spring and damper assembly including a damper unit smoothing movements of the door.

5. The oven according to claim 2, wherein the door linkage assembly further includes:

a second arm connected to the door; and a third arm interconnecting the first and second arms.

6. The oven according to claim 5, wherein the door linkage assembly further includes:

a cam follower provided on the third arm; and a cam link having a profiled portion slidably engaged by the cam follower.

7. The oven according to claim 6, wherein the door linkage assembly further includes: a spring biasing the profiled portion of the cam link into engagement with the cam follower.

8. The oven according to claim 7, wherein the spring acts on the profiled portion of the cam link to provide a force at a leading edge of the second arm at a predetermined tilt position for the door.

9. The oven according to claim 7, wherein the cam link has a first end portion pivotally connected to the outer housing, and a second end portion formed with the cam follower.

10. The oven according to claim 7, wherein the cam follower is held against the cam link by the spring and employs sliding or rolling contact against the cam link to provide a force on the second arm.

11. The oven according to claim 10, wherein the spring acts on the cam link to create a moment about a pivot point which creates a reaction force between the cam follower and the cam link.

12. The oven according to claim 2, further comprising: a latch pawl interacting with the second arm to latch the door in the closed position against an opening force applied by the spring and damper assembly.

13. The oven according to claim 12, further comprising: a latch spring connected between the outer cabinet and the latch pawl.

14. The oven according to claim 13, further comprising: an unlatch actuator acting on the latch pawl to, provide a force to overcome a force of the latch spring in order to unlatch the latch pawl.

15. A method of repositioning a door, through a linkage assembly relative to an outer housing of an oven, from a closed position extending across a frontal opening of an oven cavity selectively to first and second open positions exposing the oven cavity comprising repositioning the door through:

a) sliding the door to the first open position by vertically shifting the door along and relative to the outer to expose the oven cavity; and b) tilting the door to the second open position by pivoting the door upward and outward away from the outer housing to expose the oven cavity, wherein both the sliding and tilting is accomplished through a linkage assembly interconnecting the door and the outer housing.

16. The method of claim 15, further comprising: positioning the door to extend across venting louvers provided in an upper component housing portion of the oven when the door upon sliding the door relative to the outer housing.

17. The method of claim 15, further comprising: converting a force from a spring assembly into an opening force at a top portion of the door through an arm interposed between the door and the outer housing.

18. The method of claim 17, further comprising: engaging a cam follower, which is provided on another arm of the linkage assembly, with a profiled portion of a cam link upon opening the door.

19. The method of claim 18, further comprising: biasing the profiled portion of the cam link into engagement with the cam follower.

20. The method of claim 19, further comprising, when tilting the door open, providing a force on a leading edge of a further arm of the linkage assembly at a predetermined tilt position for the door.

21. The method of claim 18, further comprising: creating a moment about a pivot point to establish a reaction force between the cam follower and the cam link.

22. The method of claim 17, further comprising: selectively latching the door in the closed position against an opening force applied by the spring assembly.

23. The method of claim 22, further comprising: operating an unlatch actuator to shift a latch pawl against a force of a latch spring in order to unlatch the door.

24. The method of claim 15, wherein the door can be both automatically and manually shifted between the open and closed positions through either the sliding or tilting motions.

25. The method of claim 15, further comprising:

operating the oven in a cooking cycle; and automatically opening the door at the end of the cooking cycle.

* * * * *